United States Patent [19]

Bonvoisin

[11] 4,365,913

[45] Dec. 28, 1982

[54] METHOD AND DEVICE FOR BUILDING IN THE GROUND VERTICAL WALLED STRUCTURES STARTING FROM A SUBTERRANEAN CONDUIT

[75] Inventor: Jacques Bonvoisin, Liège, Belgium

[73] Assignee: Compagnie International des Pieux Armes Frankignoul, Liege, Belgium

[21] Appl. No.: 12,107

[22] Filed: Feb. 14, 1979

[30] Foreign Application Priority Data

Feb. 21, 1978 [BE] Belgium ..... 185318
Jun. 5, 1978 [BE] Belgium ..... 188318

[51] Int. Cl.[3] ..... E21D 9/04
[52] U.S. Cl. ..... 405/132; 405/184
[58] Field of Search ..... 405/184, 139, 134, 145, 405/132, 133, 150, 151, 152, 146

[56] References Cited

U.S. PATENT DOCUMENTS

| | | | |
|---|---|---|---|
| 755,955 | 3/1904 | Sooysmith | 405/132 X |
| 836,215 | 11/1906 | Reno | 405/138 |
| 960,941 | 6/1910 | Jackson | 405/139 |
| 1,800,819 | 4/1931 | Donaldson | 405/139 |
| 3,356,167 | 12/1967 | Trent | 405/184 X |
| 4,009,579 | 3/1977 | Patzner | 405/138 |
| 4,166,509 | 9/1979 | Ueno et al. | 405/139 X |

FOREIGN PATENT DOCUMENTS

| | | | |
|---|---|---|---|
| 2507984 | 9/1976 | Fed. Rep. of Germany | 405/139 |
| 1318853 | 5/1973 | United Kingdom | 405/132 |

*Primary Examiner*—Dennis L. Taylor
*Attorney, Agent, or Firm*—Haseltine and Lake

[57] ABSTRACT

The present invention relates generally to a method and a device for building in the ground vertical-walled tunnels or the like starting from a subterranean conduit, and also to the underground structures, such as tunnels or the like, obtained by the said method.

Already known in the art is the making of underground vertical walls by first providing trenches lined with sheet metal and then filling the same with concrete or with stonework or brickwork. Such trenches are usually excavated by the open-cut method, starting from the surface of the ground or from an open excavation.

Where such walls must be constructed on a surface-built urban site or at a location where communication facilities such as streets, roads, railway tracks, airport runways, etc., are established and the activities taking place at the surface must not be interfered with, the trenches may be started from underground horizontal propped galleries made by known conventional means.

The horizontal galleries, the excavation of which is started from an access shaft, serve as a starting point for making the trenches intended to form the vertical walls. The galleries also serve as conduits for ventilating, carrying away the excavated materials, conveying props, reinforcements and concrete.

14 Claims, 15 Drawing Figures

METHOD AND DEVICE FOR BUILDING IN THE GROUND VERTICAL WALLED STRUCTURES STARTING FROM A SUBTERRANEAN CONDUIT

This known method is usually employed for making tunnels for the passage of subterranean transportation means such as underground railways in large urban centres. With such a method, the inconveniences caused to surface activities are minimized.

On the other hand, a major drawback to this method is that it is extremely expensive owing to the considerable and highly skilled labour required for making the propped galleries.

The purpose of the present invention is precisely to obviate this drawback of the known method.

To this end, the invention is directed to a method and a device for constructing structures with underground walls, the excavation of which is started from subterranean horizontal conduits obtained simply, reliably and rapidly and requiring very little labour.

The invention therefore provides a method of constructing in the ground vertical-walled structures starting from subterranean conduits, consisting in excavating vertical trenches underneath the said conduits, lining the said trenches with sheet metal, placing reinforcing elements in the said trenches and then filling them with concrete or with masonry, characterized in that it consists in forming the said conduits of tubes driven horizontally into the ground at the desired level and thereafter excavating the said trenches starting from openings provided in the underside of the tubes.

Thus, the labour which formerly was necessary to excavate and fit up the propped galleries is dispensed with.

According to another characterizing feature of the invention, the said method consists in opening an access shaft from the surface down to the desired level, and then, starting from the said access shaft, in driving the said conduits horizontally into the ground by pushing them behind one another by means of hydraulic actuators bearing against a wall of the said access shaft, in withdrawing the earth entering the said conduits as they are driven into ground and in removing it through the access shaft.

The invention also provides a device for carrying out the above method, characterized in that it comprises tube sections of a mechanically resistant material and means for horizontally driving into the ground the said tube sections behind one another, such as for example hydraulic actuators placed at the bottom of an access shaft and bearing against a wall of the said shaft.

The invention also relates to a complete vault or arched roof structure for a subterranean tunnel of the aforesaid type, and also to a method of constructing the same.

The said vault or arched roof is useful for building subterranean structures such as highway tunnels, tunnel sections, underground railway stations or the like, and can be used beneath carriageways, down to at least about 1.20 m below their level without damaging them.

The said vault is preferably of the type resting on substantially vertical side-walls of masonry, particularly of concrete masonry, extending along the two side edges of the said vault, the said side walls being advantageously obtained by filling trenches from horizontal tubes placed along the said side edges, the said tubes being provided to this end with openings in their underside, as mentioned above.

The vault of masonry according to the invention is characterized in that it is formed of an upper bed constituted by a series of horizontal half-tubes arranged parallel to and apart from one another, with their convexity directed upward and their opening directed downward, and by connecting elements between the said tubes, the said half-tubes being filled with concrete or some other masonry material, and of a self-supporting lower bed, preferably of reinforced or prestressed concrete, in contact, on the one hand, with the said upper bed, and on the other hand, with the upper ends of the said side walls.

According to a preferred form of embodiment of the invention, the said connecting elements between the half-tubes consist of plates forming fluid-tight connections therebetween.

Although the said half-tubes and connecting plates may be of any suitable material, such as for example metal, reinforced concrete, prestressed concrete, asbestos cement, plastics, etc, they preferably are of metal, thus permitting in particular the fastening of the said plates to the said tubes by welding.

The invention also provides a method of constructing a masonry vault or arched roof for a subterranean tunnel, of the type comprising the construction of substantially vertical sidewalls laterally delimiting the said tunnel, the said sidewalls being preferably obtained by filling two trenches from two horizontal end-tubes provided to this end with openings in their underside, the said method being characterized in that it consists in setting a system of horizontal tubes parallel to and spaced from one another, the said tubes being distributed in accordance with the desired profile of the vault between the said two horizontal end-tubes, the said setting being preferably performed by exerting successive horizontal pushes on the individual sections constituting the said tubes, in placing connecting elements between the said tubes, preferably at substantially the middle of their height, in filling the upper half of the said tubes with concrete by means of a concrete pump, in cutting off and removing the lower half of the tubes after performing the earthwork and staying works necessary therefor, in providing a formwork under the level of the upper half-tubes remaining in place, and in depositing on the said formwork, in contact, on the one hand, with the upper bed formed of the said filled upper half-tubes and the said connecting elements, and on the other hand, with the upper portions of the said side walls, a self-supporting lower bed of masonry, preferably of reinforced or prestressed concrete.

According to a characterizing feature of the invention, the said connecting elements are connecting plates which are brought within the said tubes and pushed through their wall, between two successive tubes, after providing longitudinal slots in each of the tubes or in some of them, until they abut against the respective adjacent tubes.

According to another characterizing feature of the invention, a formwork is provided substantially at the level of the diametral plane separating the upper portion from the lower portion of each tube, before filling the said upper portion with concrete, and reinforcing elements such as reinforcing bars are placed before the said filling of the upper portion. The said formwork may be constituted in particular by a planking or by prefabricated reinforced-concrete slabs preferably provided with reinforcing metal elements projecting from the surface of the said slabs and capable of being connected to the aforesaid reinforcing elements.

The aforesaid filling may be advantageously performed, for each tube, by means of a rigid pipe inserted into the upper portion of the tube or tube section to be filled, the said pipe being connected through a hose, preferably of the same diameter as the pipe, to the aforesaid concrete pump, which discharges high-fluidity concrete, while the tube to be filled is closed at both ends, the said pipe remaining in place after the filling.

The invention will be better understood and other purposes, characterizing features, details and advantages thereof will appear more clearly as the following explanatory description proceeds with reference to the appended diagrammatic drawings given solely by way of example illustrating several forms of embodiment of the invention and wherein.

Figure 8:
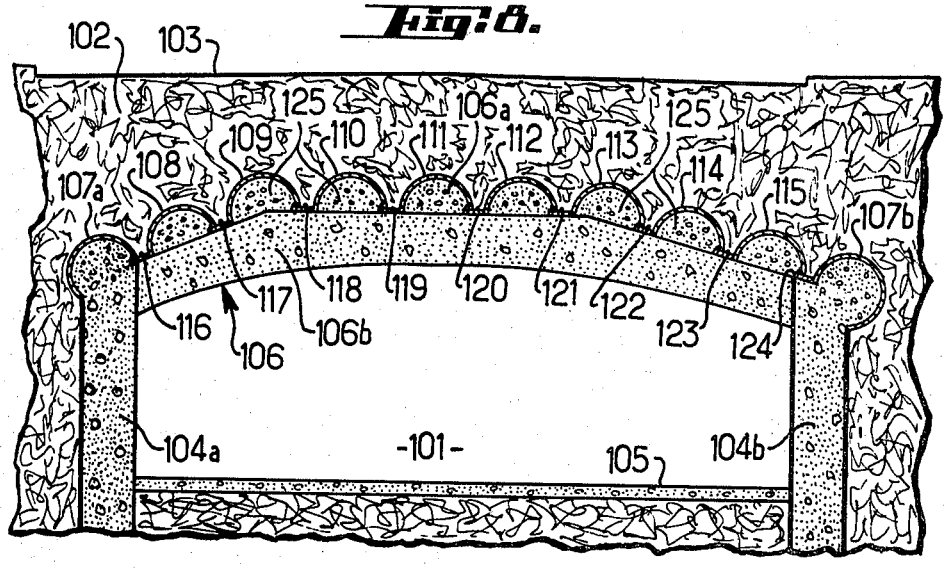
FIG. 8 is a cross-sectional view of a subterranean tunnel provided with a vault or arched roof according to one form of embodiment of the invention.
Figure 9A:
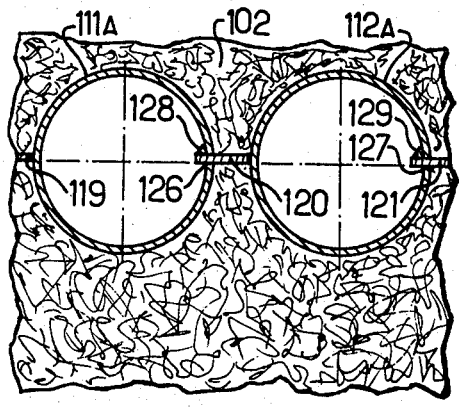
Figure 9B:
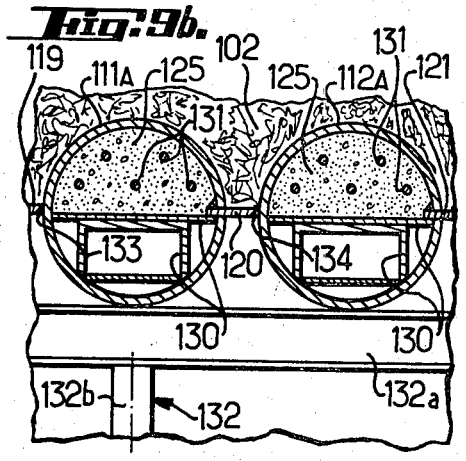
Figure 9C:
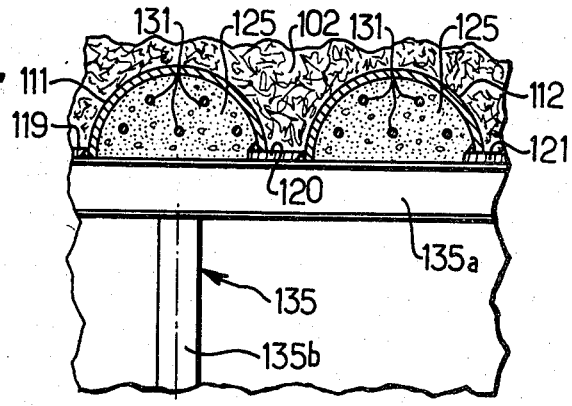
Figure 10:
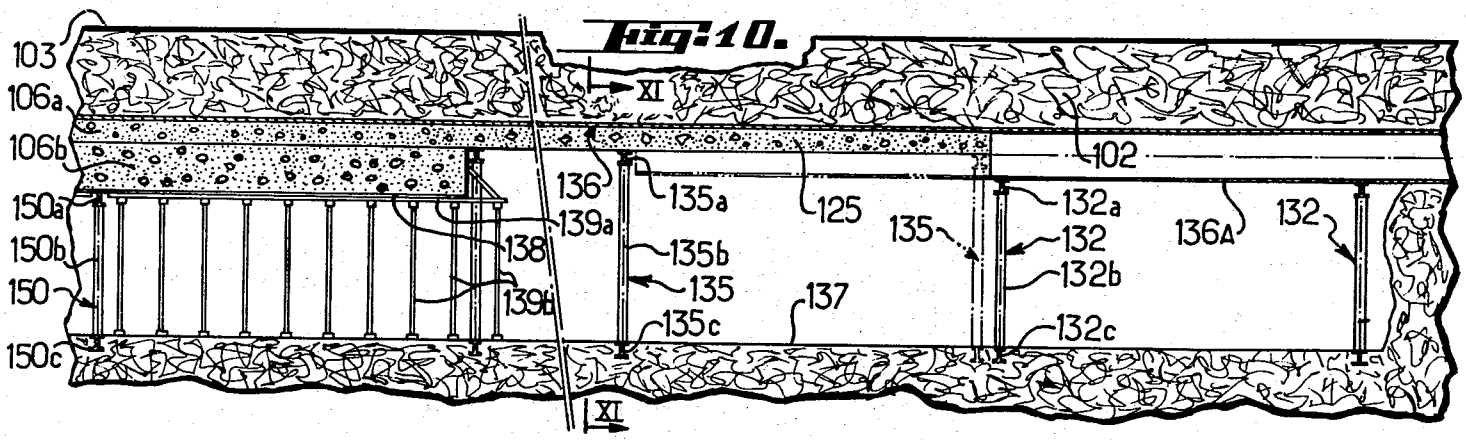
Figure 11:
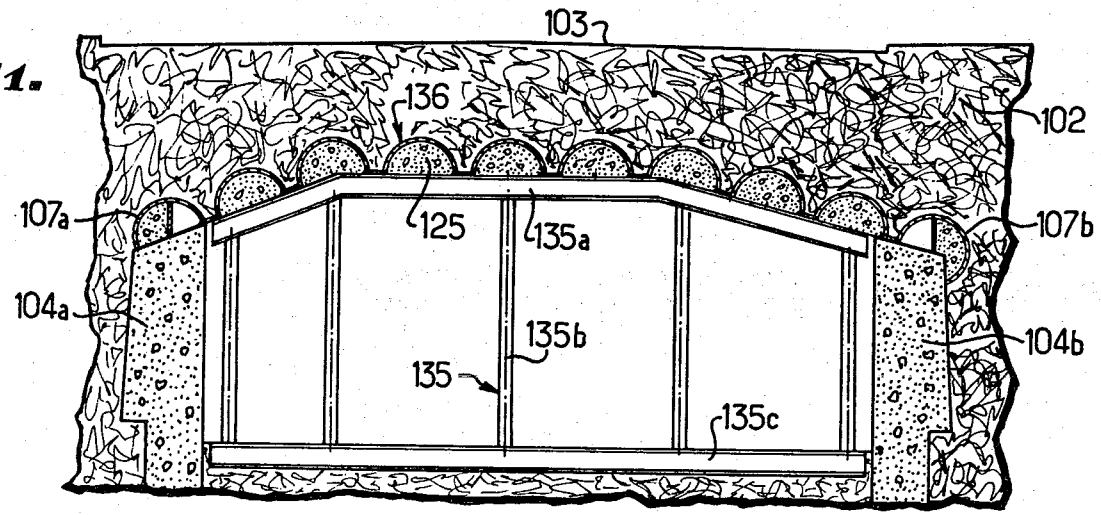
Figure 12:
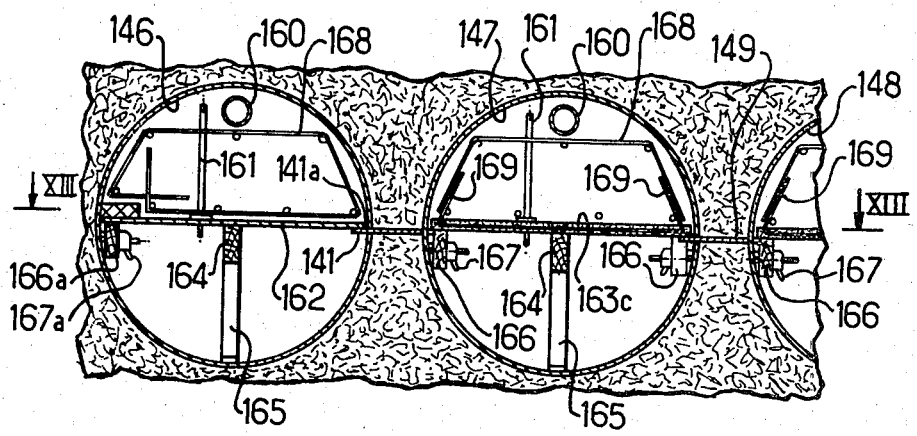
Figure 13:
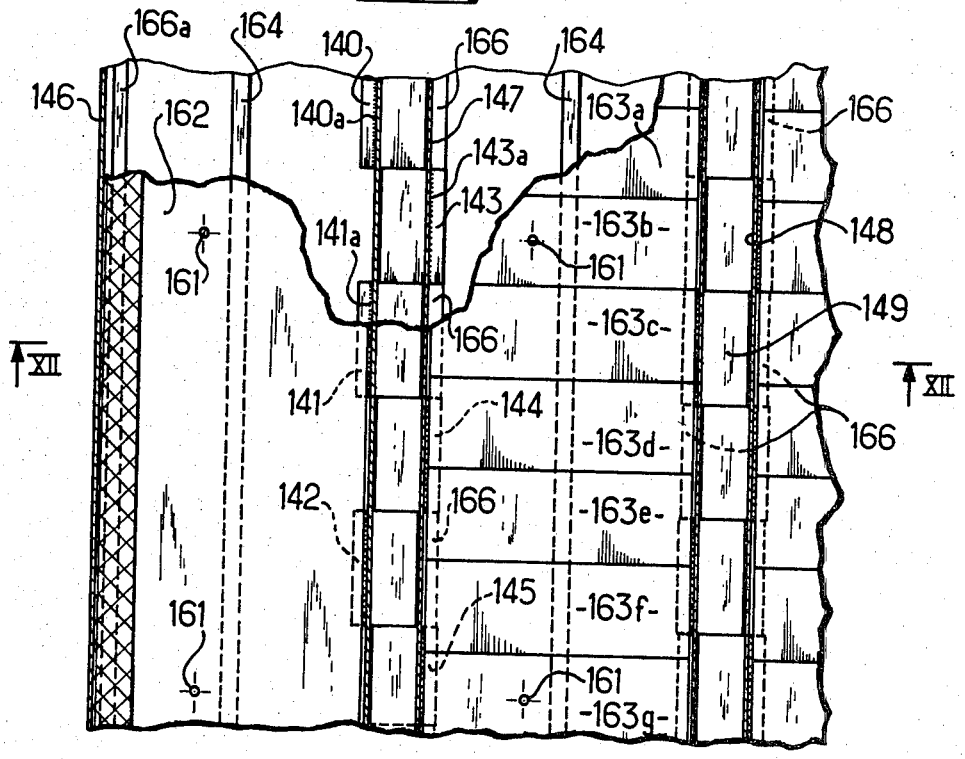

FIGS. 9*a* to 9*c* are detailed partial cross-sectional views of the vault of FIG. 8, illustrating various stages of the method of construction of the vault;

FIG. 10 is an axial longitudinal sectional view of the whole subterranean tunnel of FIG. 8 together with its vault, showing the various stages of vault construction;

FIG. 11 is a cross-sectional view of the said subterranean tunnel, upon the line XI—XI of FIG. 10;

FIG. 12 is a cross-sectional view, upon the line XII—XII of FIG. 13, of a lateral end section of the upper bed of a vault according to another form of embodiment of the invention; and FIG. 13 is an axial horizontal longitudinal sectional view of the same bed upon the line XIII—XIII of FIG. 12. Referring to the drawings, the prior art will first be described for a better understanding of the invention and its advantages over the prior art.

Figure 1:
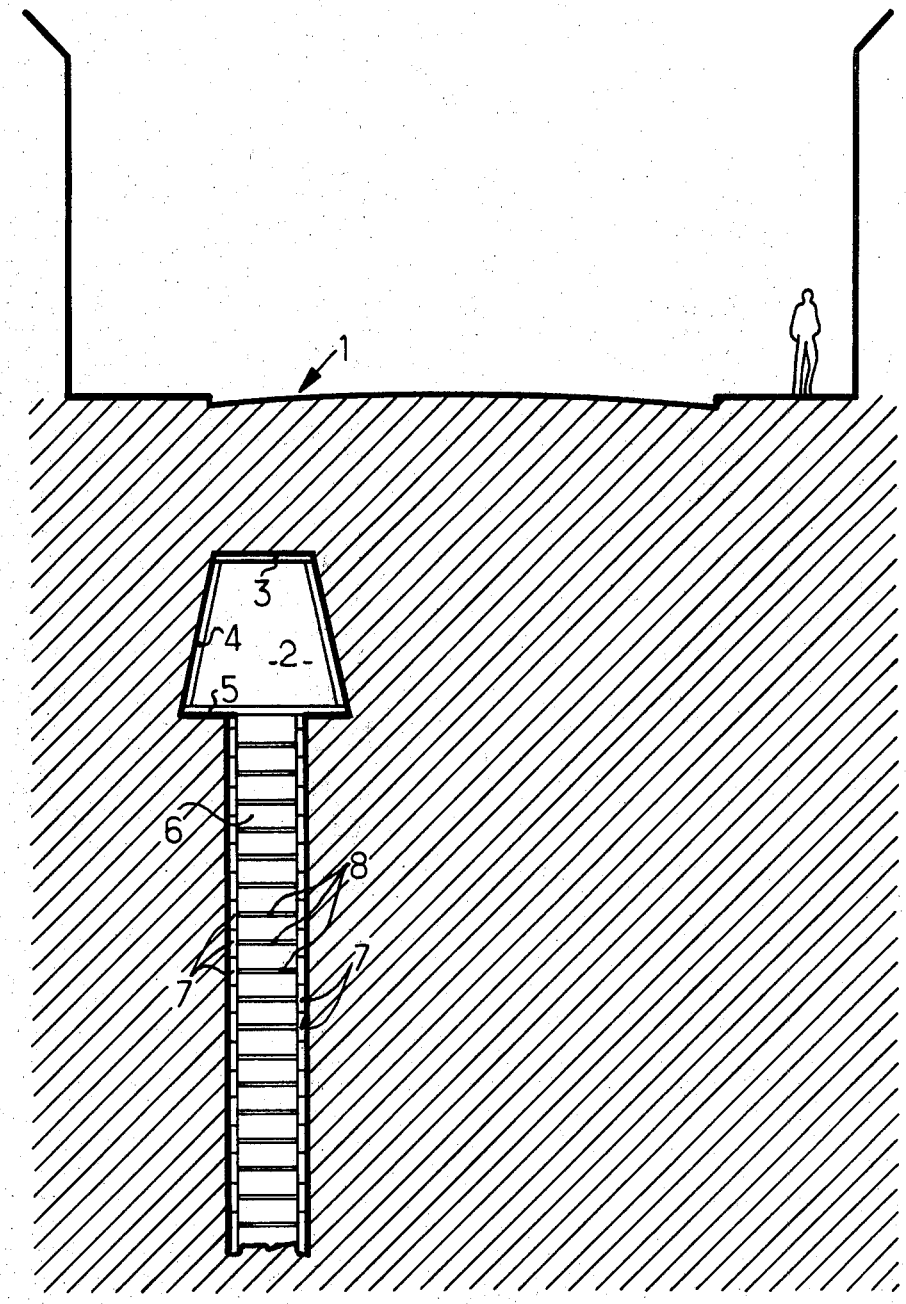
Fig. 1. PRIOR ART
FIG. 1 is a diagrammatic vertical cross-sectional view of a buttressed gallery and a sheet-metal lined trench, according to the prior art.

In FIG. 1, reference 1 denotes the surface of the ground, e.g. in a surface-built urban area, the Figure represented on the right side as a guide being drawn to scale.

According to the prior-art, a horizontal gallery 2 is excavated starting from an access shaft (not shown), and then propped or buttressed at 3, 4 and 5 in a conventional manner. From the horizontal bottom of this gallery, a trench 6 is excavated and lined, as the excavation progresses, by means of sheet-metal elements 7, 8 of a known type. The elements 7 consist of rigid plates placed against the vertical walls of the trench and interconnected from one wall to the other by the elements 8. The gallery 2 is of course large enough to provide room for the passage of the workers and the carrying out of all the necessary works: excavation of the trench 6, removal of the earth, supply and placing of reinforcement elements in the trench, concreting of the trench, etc.

This known method is reliable, but as already pointed out, its cost is extremely high due to the highly skilled work that is necessary for propping, buttressing or otherwise supporting the walls of gallery 2.

There will now be described, with reference to the following Figures, a method and a device according to the invention allowing the above drawback of the prior art to be obviated.

Figure 2:
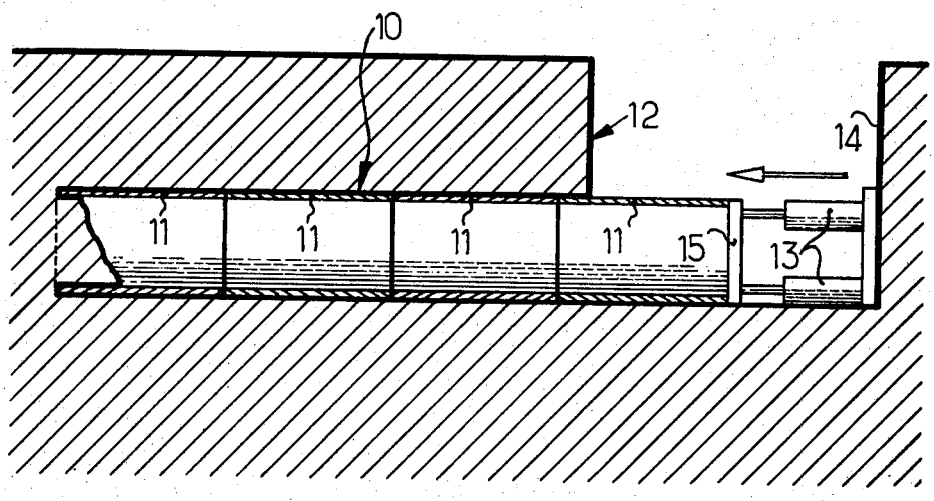
FIG. 2 is a longitudinal vertical sectional view of one stage of the method according to the invention, illustrating the driving of the tube sections into the ground from an access shaft.
Figure 3:
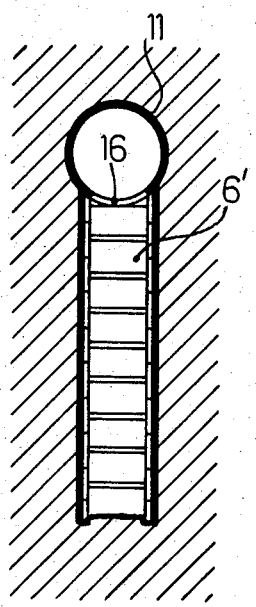
FIG. 3 is a vertical cross-sectional view of a tube section and a trench according to the invention.
Figure 4:
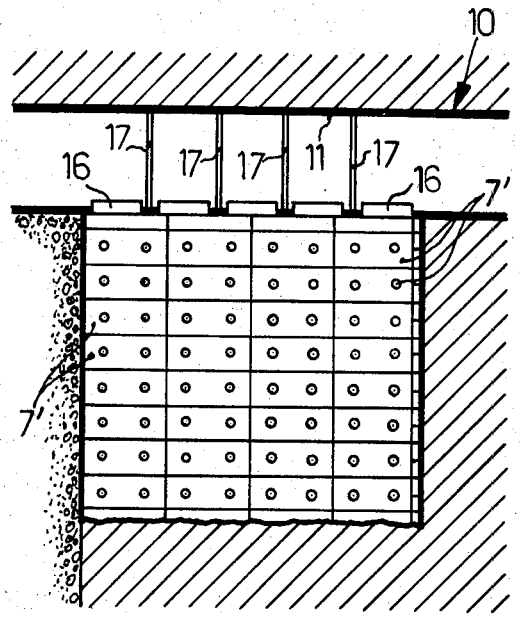
FIG. 4 is a longitudinal vertical sectional view corresponding to FIG. 3.

According to the invention, the propped or buttressed gallery 2 is replaced by tubular conduit 10 generally cylindrical in shape and formed of prefabricated elements 11 of appropriate length which are driven horizontally into the ground. To this end, and as in the case of the buttressed gallery, an access shaft 12 is sunk from the surface of the ground down to the desired level. Means such as for example high-power hydraulic actuators 13 are arranged at the bottom of the access shaft so as to bear at one end against a wall 14 of the access shaft. The other end of the hydraulic actuators, constituted by the end of their piston rods, is provided with a vertical plate 15 adapted to bear against the end of a pipe section 11 so as to push and drive it horizontally into the ground. When a pipe section 11 is thus completely or almost completely driven horizontally into the ground, the following section 11 is moved down into the access shaft and aligned with the section 11 already driven in the ground, and is thereafter pushed against and together with the preceding pipe section by means of the actuators 13. The underground tubular conduit 10 represented in FIG. 2 is thus obtained.

The sections 11 pushed horizontally into the ground are open and therefore filled with earth while being driven. The sections 11 are large in diameter, e.g. on the order of 2 m, and the earth within the tubular conduit 10 can thus be removed therefrom and finally carried to the surface through the shaft 12.

The tube sections 11 are of a suitable strong material capable of withstanding without damage the stresses resulting from the pressure of the earth and the driving force exerted by the hydraulic actuators 13. The tube sections are prefabricated elements made for example of steel, reinforced concrete, prestressed concrete, asbestos cement, plastics, etc.

They are moreover provided, in their underside, with openings 16 which will permit the excavation of a sheet-metal lined trench 6' for making the desired vertical wall. At the locations weakened by the said openings, the tube sections 11 are strengthened by arches 17 of an appropriate material, arranged for example on either side of the openings 16. As already pointed out, the inner dimension of the tube sections 11 is enough to provide room for the passage of the workers and the carrying out of the necessary works through the openings 16: excavation of trenches 6', placing of sheet-metal lining elements 7' and 8', supply and placing of reinforcing means 18 in the trenches 6', filling of the trenches 6' with concrete or masonry.

Figure 5:
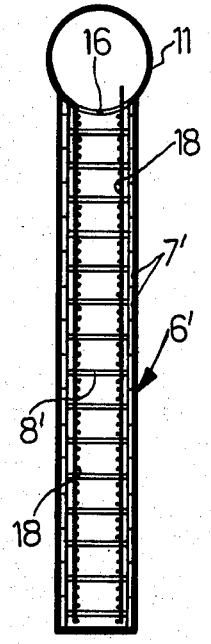
FIG. 5 is a vertical cross-sectional view corresponding to FIG. 3, after the concrete reinforcing means are placed in the trench.
Figure 6:
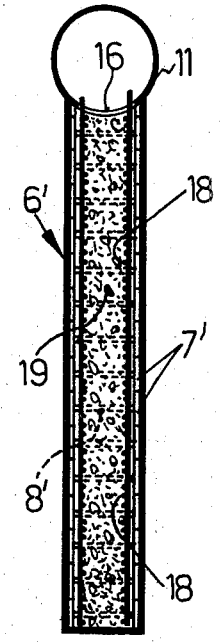
FIG. 6 is a view corresponding to FIG. 5, showing the trench after the concreting.

In FIG. 5 is shown by way of example the trench 6' with the reinforcing means 18 placed therein, and in FIG. 6 is shown the vertical wall 19 obtained after concreting the trench 6'.

Figure 7:
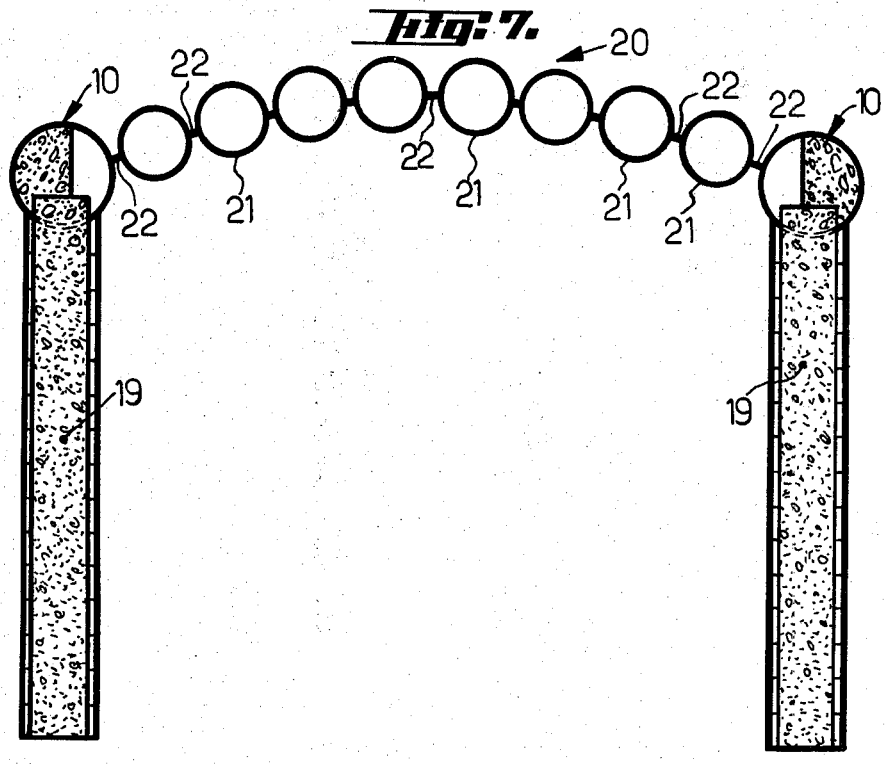
FIG. 7 is a diagrammatic vertical cross-sectional view of a structure provided with a roof according to the invention.

The method according to the invention may also be used in constructing the roof of a subterranean structure e.g. an underground railway tunnel, as shown in FIG. 7.

In this Figure, the two tubular conduits 10, each associated with a vertical wall 19, form part of a set 20 of tube sections 21 driven horizontally into the ground in parallel relationship to one another and to the tubular conduits 10 and intended to form the temporary or the permanent roof of, for example, a tunnel. The tube sections 21 are connected with one another and with the tubular conduits 10 by systems of metal plates 22 or injections, so as to impart an integral structure to the whole assembly. It is understood that the tubes 21 are driven horizontally into the ground in the same manner as the tubular conduits 10, being connected to the adjacent tubes 21 by the sytems of metal plates 22 or injections, and that the tubes 21 are thereafter filled with concrete or masonry to form the roof of the subterranean structure.

It is understood that the tubular conduits 10 associated with the vertical walls 19 form two parallel lines of tube sections and that the tube sections 21 form mutually parallel intermediate lines connected to the lateral lines formed by the tubular conduits 10.

The tube sections 11 or 21 may be circular, polygonal, or partly circular and partly polygonal in cross-section.

The method and device according to the invention offer over the prior art the following additional advantages:

there is no need to effect previous injections of concrete into the ground, for the combination of the tubes 10 and 21 with the vertical walls results in a perfectly fluid-tight assembly:

the method according to the invention reduces surface subsidence or settling and the damages caused by the construction of such subterranean structures;

the method according to the invention is much safer for the workers, who can work sheltered by a continuous tube of steel, concrete, plastics, etc;

by reason of the reduction in surface subsidence, it is possible to work nearer to the surface of the ground.

In FIG. 8 is shown a subterranean tunnel 111 excavated in the ground 102 above the ground surface 103, which, for example, is the surface of a carriage-way or road pavement. The tunnel structure comprises side walls 104*a* and 104*b*, a floor 105 and a vault or arched roof 106, these various elements of the structure being preferably of reinforced or prestressed concrete. The reference numerals 107*a* and 107*b* denote the two horizontal end conduits which have been used for excavating and filling the trenches occupied by the side walls 104*a* and 104*b*, respectively.

The vault 106 is formed of an upper bed 106*a* and a self-supporting lower bed 106*b*, the latter being in contact, on the one hand, with the upper bed 106*a* and, on the other hand, the upper ends of the side walls 104*a* and 104*b*. The upper bed 106*a* is constituted by a series of horizontal half-tubes 108 to 115 arranged parallel to and apart from one another, with their convexity directed upward and their opening directed downward, and by connecting elements 116 to 124 between the said half-tubes 108 to 115, the latter being filled with concrete or another appropriate masonry material 125.

Reference is now made to FIGS. 9*a* to 9*c*, which illustrate the essential stages of the method of constructing the vault 106. Each of the half-tubes 108 to 113 of FIG. 8 results from the elimination of the lower half of a series of horizontal tubes 111A and 112A shown in FIG. 9*a*. These tubes have been placed by any appropriate means, preferably as described in reference to FIG. 7.

In FIG. 9*a* are seen the two tubes 111A and 112A which, at this stage of the construction method, are embedded in the surrounding ground 102, the transverse dimension of these tubes being such as to provide enough room for the passage of the workers. In the example illustrated, all these tubes are of metal, and so are the connecting elements such as 119, 120 and 121 constituted by metal plates. These plates form a fluid-tight connection between the successive tubes, as seen in FIGS. 1 and 2*a* to 2*c*. The placing of the connecting plates such as 120 and 121 is performed by first providing a longitudinal slot 126 and 127, respectively, substantially at the middle of the height of one of the sides of tubes 111A and 112A and then inserting the metal plates 120 and 121, respectively, into the slots 126 and 127, by pushing the same, by any suitable means, from the interior of tubes 111A and 112A until the said metal plates abut against the outer surface of the adjacent tubes, i.e. the outer surface of tube 112A in the case of the metal plate 120 brought within the tube 110A and pushed from the interior of this tube through the slot 126. The plates such as 126 and 127 are welded to the metal tubes from the interior of which they have been put in place, along an internal longitudinal welding line 128 and 129, respectively, in the case of tubes 111A and 112A.

If desired, water-tightness between the successive tubes of the vault can be ensured by inserting plastics sections, e.g. of polyvinylchloride, between the connecting plates extending consecutively lengthwise of the tubes between two adjacent tubes.

FIG. 9*b* shows the considered vault portion after the filling of the upper half of the tubes with concrete. This stage is obtained in the following manner starting from the stage illustrated in FIG. 9*a*. A formwork illustrated diagrammatically at 130 is provided to delimit the upper portion of each of the tubes such as 111A and 112A, and reinforcing elements such as reinforcement bars 131 are placed, and then the upper halves of the said tubes are filled with concrete. Use is made, to this end, of a concrete pump supplying high-fluidity concrete so that a single concrete pump located outside the structure can ensure the filling of a sufficient tube length in a single operation. To this end, the tube section whose upper portion is to be filled with concrete is obturated at both ends and supplied with concrete through a pipe extending throughout substantially the length of the said section, the said pipe being rigid in order to supply the said tube section with concrete throughout its length. The pipe is connected to the concrete pump through, preferably, the medium of a flexible conduit or hose of the same diameter as that of the pipe.

If the filling of the upper portion of the tubes by the means thus used is not considered to be sufficiently complete. a make-up mortar injection or grouting is performed, preferably by means of small pipes placed vertically, into the portion to be concreted, the said small pipes being supplied through their lower portion opening into the lower half of the horizontal tubes. It is also seen in FIG. 9*b* that the earth below the medial level of the tubes has been removed and that temporary support frames, designated generally by the reference numeral 132, have been provided to transmit the load to the floor (see also FIG. 10), the said support frames comprising in particular upper horizontal beams 132*a* and vertical beams 132*b*. It is precisely at this stage that the connection bewtween the horizontal tubes and the connecting plates such as 119 and 120 can be strengthened, if appropriate, by wlelding to the outside of the said tubes, the plates abutting thereagainst, along external longitudinal welding lines, such as 133 and 134 in the case of the connecting plates 119 and 120, respectively, abutting against the tubes 111A and 112A.

FIG. 9*c* illustrates a later stage of the vault constructing method, during which the lower halves of the tubes, such as 111A and 112A, have been cut off and extracted, so that only the upper half-tubes such as 111 and 112 interconnected by the connecting plates such as 120 and filled with concrete 125 have remained in place. At this stage, support frames 135 comprising in particular upper horizontal beams 135*a* and vertical beams 135*b* transmit to the tunnel floor the load exerted by the temporary roof thus constituted.

According to a modified form of embodiment of the invention, the earthwork and the staying works can be performed by using, according to another method called the "Berlin method," sheet-metal linings instead of the aforesaid frames (which permit excavation in stopes by means of earthworking appliances).

In FIG. 10 and/or FIG. 11 are again seen the vertical side-walls 104*a* and 104*b*, the horizontal end-tubes 107*a* and 107*b* and the intermediate half-tubes which here are denoted by the common reference numeral 136, the tunnel floor being designated by the numeral 137. In the right-hand portion of FIG. 10 it is seen that the support frames 132 constituted by beams such as 132*a*, 132*b* and 132*c* have been placed under the intact tubes denoted by the common reference numeral 136A, the said portion of FIG. 10 corresponding to the stage illustrated in FIG. 9*b*. In the following tunnel section, located in the middle of FIG. 10, the lower halves of tubes 136A have been cut off (the said lower halves being shown in phantom lines ) and eliminated, so that now the load of the structure is transmitted to the tunnel floor 137 by the support frame 135 comprising the beams 135*a*, 135*b* and 135*c*, this portion of the tunnel corresponding to the stage illustrated in FIG. 9*c*. In the left-hand portion of FIG. 10, the tunnel section that is represented illustrates the stage of constructing the self-supporting lower bed 106 of the vault, a formwork constituted by a planking 138 supported by horizontal beams 139*a* and vertical beams 139*b*, having been previously placed to this end. Moreover, support frames 150 constituted by beams 150*a*, 150*b* and 150*c* help in supporting the concrete bed 106*b*.

In the form of embodiment illustrated in FIGS. 12 and 13, the general structure or the tunnel vault and the method of constructing the same are similar to those of the form of embodiment illustrated in FIGS. 8 to 14, but the form of embodiment of the formworks within the tubes is different. Furthermore, it is clearly seen that the connecting plates, such as 140, 141 and 142, put in place from within a tube such as 146 and welded thereto along internal welding lines such as 140*a* and 141*a* alternate with connecting plates such as 143, 144 and 145 put in place from within the adjacent tube 147 and welded to this tube along internal welding lines such as 143*a*.

In FIG. 12 are seen the horizontal pipes 160 serving to supply concrete into the upper portions of the tubes, such as 146, 147 and 148, from the concrete pump, and also the small vertical pipes 161 for injecting make-up mortar to complete the filling of the said upper portions. The formwork here is constituted by a planking 162, as shown for the vault end-tube 146, or by small prefabricated slabs of reinforced concrete, such as 163*a* and 163*b* for the tube 147. These slabs are supported by appropriate support means such as longitudinal wood beams 164 supported by pillars 165, and those portions of the connecting plates that protrude within the tubes, in association with wood beam lengths, such as 166, alternating with the said portions lengthwise of the tubes and secured by means of studs such as 167, welded to the wall of the said tubes. The planking 162, on the contrary, is supported at its centre only by the beam 164, at its right-hand edge by the protruding portions of the connecting plates, and at its left-hand edge by a longitudinal wood beam 166*a* secured to the tube 146 by studs 167*a*.

The reference numeral 168 denotes the reinforcement of the concrete mass (not shown) to be introduced into the upper portion of the tubes, such as 146, 147 and 148.

It would be noted that each prefabricated reinforced-concrete slab, such as 163*a*, may be provided with metal reinforcement elements protruding at 169, on the upper surface of the said slabs, and therefore capable of being assembled to the reinforcement 168.

Of course, the constitution and construction of the self-supporting lower bed depend upon the particular characteristics of the whole structure to be obtained and the description just given is only an example thereof.

Of course, the invention is by no means limited to the forms of embodiment described and illustrated which have been given by way of example only. In particular, it comprises all means constituting technical equivalents to the means described as well as their combinations, should the latter be carried out according to its gist and used within the scope of the following claims.

What we claim is:

1. A method of building in the ground vertical-walled structures, such as a subterranean tunnel, starting from the subterranean conduits, comprising the steps of: driving horizontally into the ground, two parallel lines of tubes, spaced a predetermined distance from one another; in constructing beneath each line of tubes corresponding vertical walls; and interconnecting the two lines of tubes through a certain number of intermediate parallel lines of tubes driven horizontally into the ground, in which the tubes are tightly connected to the parallel adjacent tubes in such a manner that the two parallel lines and the intermediate lines of tubes form the roof of a tunnel, to be formed between said vertical walls.

2. A method according to claim 1, in which said vertical walls are built by the steps comprising: placing reinforcement elements and filling with concrete or masonry in the trenches, starting excavation from opening provided in the underside of the tubes, and forming said two parallel lines of tubes.

3. A method according to claim 1, comprising the steps of: driving the tubes horizontally into the ground, starting from a vertical access shaft, by pusing said tubes behind one another by means of hydraulic actuators bearing upon a wall of the access shaft, withdrawing the earth from within the tubes driven into the ground, and removing the said earth through the access shaft.

4. A method according to claim 1, for building a masonry vault or arched roof for a subterranean tunnel, comprising the steps of placing a system of parallel and mutually spaced horizontal tubes distributed in accordance with the desired profile of the vault between the said two horizontal end-tubes, in arranging connecting elements between the said tubes, preferably at the middle of the height thereof, in filling with concrete, by means of a concrete pump, the upper half of the said tubes, in cutting off and removing the lower half of the said tubes, after carrying out the earthwork and staying works necessary therefor, in providing a formwork under the level of the upper half-tubes remaining in place, and in placing on the said formwork, in contact, on the one hand, with the upper bed formed by the said filled upper half-tubes and the said connecting elements and, on the other hand, with the upper portions of the said side walls, a self-supporting lower bed of masonry, preferably of reinforced or prestressed concrete.

5. A building method according to claim 4, wherein said connecting elements consist of connecting plates which are brought into the said tubes and pushed out through their wall, between two consecutive tubes, after providing longitudinal slots in each or only one of the said tubes, until the said plates abut against the adjacent tube.

6. A method according to claim 5, wherein said tubes and the said connecting plates are of metal, each of the said plates being welded to the tube from which it has put in place, from the interior of this tube, along an internal longitudinal welding line, before filling the upper half of the tubes.

7. A method according to claim 5, wherein plastic sections are inserted between the plates arranged consecutively, lengthwise of the said tubes, between two adjacent tubes, so as to obtain water-tightness.

8. A method according to claim 5, wherein said tubes and the said connecting plates are of metal and that each of the said plates is welded to the tube against which it is abutting, from the exterior of the said tube, along an external longitudinal welding line, after filling the upper half of the tubes and, preferably, before cutting off and removing the lower half of the latter.

9. A method according to claim 4, wherein a formwork is provided substantially at the level of the diametral plane separating the upper portion from the lower portion of each tube, before filling the said upper portion with concrete, and that reinforcement elements such as reinforcement bars are placed in this upper portion before the said filling.

10. A method according to claim 9, wherein said formwork is constituted by a conveniently supported planking.

11. A method according to claim 9, wherein said formwork is constituted by prefabricated reinforced-concrete slabs provided with metal reinforcement elements protruding on the surface of the said slabs and capable of being connected to the reinforcement elements placed in the upper portion of the tubes.

12. A method according to claim 4, wherein said filling is performed, for each tube, by means of a rigid pipe inserted in the upper portion of the tube section to be filled, the said pipe being connected, preferably by means of a flexible conduit, of the same diameter as the said pipe, to the aforesaid concrete pump, which delivers high-fluidity concrete, whereas the tube section to be filled with concrete is closed at both ends, this pipe remaining in place after the filling.

13. A method according to claim 12, wherein said filling is completed, if it has not been performed sufficiently completely by the said pipe, by an injection of make-up mortar, preferably by means of small pipes.

14. A method according to claim 4, said aforesaid earthwork and staying works are performed in a manner known per se, using sheet-metal linings, according to the method called the "Berlin method" or using support frames allowing the load to be transmitted to the tunnel floor and the excavation to be performed in stopes by means of earthworking appliances.

* * * * *